United States Patent [19]

Yang

[11] 4,289,003

[45] Sep. 15, 1981

[54] KEY HOLDER

[76] Inventor: Tayhugh L. Yang, 401 Robert E. Lee Blvd., New Orleans, La. 70124

[21] Appl. No.: 37,659

[22] Filed: May 10, 1979

[51] Int. Cl.[3] ..... A47G 29/10

[52] U.S. Cl. ..... 70/456 B

[58] Field of Search ..... 70/456 B, 456 R, 457, 70/458, 459; 24/3 K, 3 D; 150/40

[56] References Cited

U.S. PATENT DOCUMENTS

| | | | |
|---|---|---|---|
| 1,138,768 | 5/1915 | McFarland | 70/456 R |
| 2,362,280 | 11/1944 | Kollock | 70/458 |
| 2,669,113 | 2/1954 | Gillette | 70/456 R |

FOREIGN PATENT DOCUMENTS

| | | | |
|---|---|---|---|
| 1314093 | 11/1962 | France | 70/459 |
| 18669 | of 1912 | United Kingdom | 70/459 |

*Primary Examiner*—Robert L. Wolfe

*Attorney, Agent, or Firm*—C. Emmett Pugh & Associates

[57] ABSTRACT

A key case for holding and enclosing one or more keys in a more orderly, compact manner while allowing ease of selection, freedom of use, and ease of restorage after use. This is accomplished using a single, triangularly shaped key-holder, which holds all the keys in the key case, and attaching it at one corner to the body of the key case by a double-hinge, universal pivot mechanism, with the keys being stored in face-to-face engagement in an "upside-down" disposition (FIG. 3). The triangular key holder in storage disposition allows for a reduction in size of the key case and further incorporates semicircular corners at its base to facilitate control and separation of the keys while a key is being put in use (FIG. 1).

18 Claims, 5 Drawing Figures

KEY HOLDER

BACKGROUND OF THE INVENTION

1. Field of the Invention

This invention relates to any application where keys as those commonly found in homes and offices must be periodically handled and used. It is particularly applicable to the use of pocket key cases to prevent wear and unsightly bulges in clothes where compactness and ease of selection of the proper key is essential.

2. Prior Art

The use of keyholders within key cases has been prevalent for many years wherever keys must be used and selected in an orderly manner, and carried where damage might occur to clothing or compactness is desirable. The prior art includes the following patents:

R. H. Wendt, U.S. Pat. No. 2,564,242
Castro, U.S. Pat. No. 3,011,537
Rubenstein, U.S. Pat. No. 3,294,137
Campbell, U.S. Pat. No. 2,541,333
Hawes, U.S. Pat. No. 2,360,675
Wright, U.S. Pat. No. 2,270,015
Nevesink, U.S. Pat. No. 3,379,041
Heiring, U.S. Pat. No. 1,843,923
Nasser, U.S. Pat. No. 2,130,469

This invention stems from the inventor's own dissatisfaction with such prior and current art. This dissatisfaction culminated in a new method of retaining keys inside a key case in a more compact manner while also allowing greater flexibility, spacing, and ease of use of a selected key for its intended purpose than earlier designs.

SUMMARY DISCUSSION OF THE INVENTION

An important part of this invention lies in the unique combination of two developments. The first development is the use of a single loop keyholder within the case of a triangular configuration with semicircular corners where the legs and the base of the triangle intersect. The triangular shape allows for more compact storage of the keys in an upside-down disposition within the key case due to its flat base. When the keys are in their "storage" disposition, the key case need only be as long as the longest key with no bulk above or below the keys necessary for their attachment to the key case (see dimensional arrows B, FIG. 3). The triangular shape of the key holder loop also allows for more freedom of movement of the keys. The legs of the triangle facilitate random manipulation of all the keys in the "key-in-use" position, FIG. 1, as it allows maximum spacing between the triangular configuration and the key case. The corner attachment of the triangular key holder further allows a point to which unused keys may fall in the "key-in-use" position. Since a key in use always seeks the corner of the triangular configuration and the corner of the triangle is always the furtherest distance from the key case due to the universal coupling, there is greater freedom of movement and separation of the key in use from the other keys than in previous designs (note dimensional arrows A of FIG. 1).

The semicircular corners of the triangular configuration allow the keys to move freely from the triangle base to the legs of the triangle during the transitions between the "key-in-use" mode and the "storage" mode. They also allow better control of the key in use because it is "confined" to the semicircle corner and cannot slide about as it might if a completely circular key holder configuration were used.

The second unique development which contributes to the advantages of this invention is the double hinged pivot means universally attaching the triangular loop keyholder to the case body. This allows a greater degree of freedom in manipulation of the triangular loop keyholder while it is in the "key-in-use" position, FIG. 1, and aids in storage of the keys.

Therefore, the combination of the unique developments of the triangular loop keyholder and the universal means of attaching it to the key case create advantages in ease of use and selection of keys, and in compact storage size not found in the prior art. (See height and depth dimensional arrows B and C in FIGS. 3 and 4, respectively.

DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Structure

Figure 1:
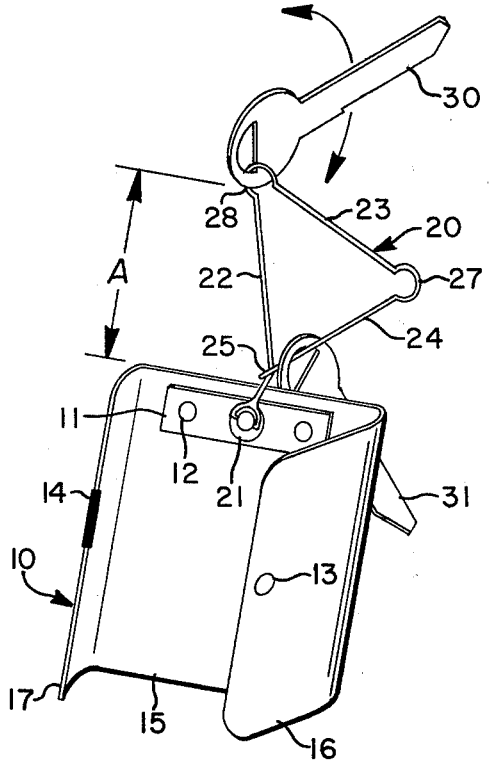
FIG. 1 is a perspective view of the preferred embodiment of the key case of the present invention with the case open showing the triangular loop keyholder in the "key-in-use" disposition with the position of the exemplary key not in use hanging from one of its legs.
Figure 3:
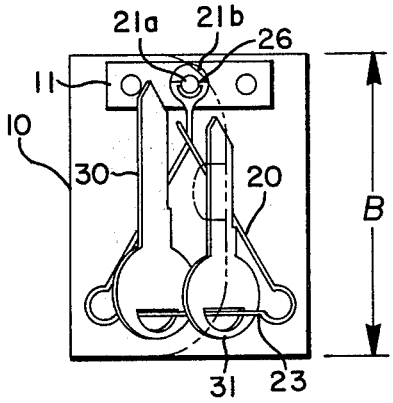
FIG. 3 is a plan view with the flaps of the closed cover in phantom line showing the internal triangular keyholder in the same position as in FIG. 2, but with the keys rotated up about the base of the triangular keyholder to their storage disposition.

The preferred embodiment of the key case 10 of the present invention, as illustrated in FIG. 1, comprises a soft, flexible case body of leather or like synthetic or cloth material which is capable of enclosing the keys 30, 31 in their storage position (FIG. 3). Contained within the case 10 is a single key holding loop means 20 having a triangular configuration to retain and hold the keys 30, 31, with a universal double hinge mechanism 21 for attaching the loop means 20 to the case body 10. It is noted that the keys 30, 31 have holes at their bases through which the loop 20 extends with the key shanks extending away from the loop 20.

The case body 10, which includes a back section 15 and side, cover flaps 16 and 17, can be made of a hinged, rigid material, but a soft, tough, flexible material, as used in the prior art, is preferred. In the unfolded, flat position of FIG. 2 the case body 10 is generally of rectangular shape and is equipped with a securing male/-female snap 13, 14 which keeps the case body 10 in the closed, storage disposition shown in FIGS. 3 and 4. It is noted that, when in the storage disposition, the keys lie side-by-side at an angle (for example fifteen degrees) to the base 23 with the keys in partial face-to-face engagement (note FIG. 4) with the shanks of the keys extending from the base side 23 upwardly toward the attachment mechanism 21.

The single loop key holding means 20 for retaining the keys 30, 31 in the key case 10 has a triangular configuration to maximize the efficiency of size in the "B" dimension, note FIG. 3, and facilitates selection and use of the keys as needed. A spring hook 25 at the end of the first leg 24 of the triangular configuration may be unhooked from the second leg 22 due to the elasticity or springiness of the wire material of the triangular key holder 20. The wire material of the loop 20 is rigid in the sense that it is at least self-supporting and retains a basic, set shape in use but can be of springy material at least at its hook end 25 to usually hold itself together in its latched position. This allows keys to be added or substracted from the triangular keyholder 20. The triangular keyholder 20 allows keys 30, 31 to be positioned in the case body 10 in such a way that the longest key in storage should just about equal the entire length B of the case body as shown in FIG. 3. The triangular keyholder 20 further allows greater separation of the key 30 in use from the key(s) 31 not in use and from the case body 10 (see generally dimension A, FIG. 1). This allows greater flexibility and control of the exemplary key 30 when in use.

Semicircular corners 27, 28 connect the legs 22, 24 with the triangle base 23. The semicircular corners 27, 28 facilitate the movement of the exemplary keys 30, 31 between the "key-in-use" disposition, FIG. 1, and the "storage" disposition about the triangle base 23, FIGS. 3 and 4.

Figure 5:
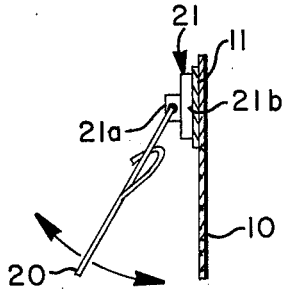
FIG. 5 is a partial, side, cross-sectional view of the preferred embodiment, taken along sections lines 5—5 of FIG. 2, showing the back of the key case and its connection with the key holder and illustrating the other degree of freedom of the triangular keyholder due to the double hinge mechanism (note directional arrows).
Figure 4:
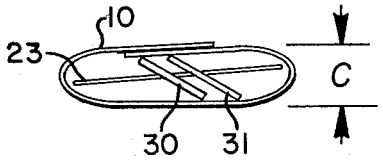
FIG. 4 is an end view of the preferred embodiment of the key case with the flaps closed showing the compact nature (depth C) of the key case with the keys in storage disposition.
Figure 2:
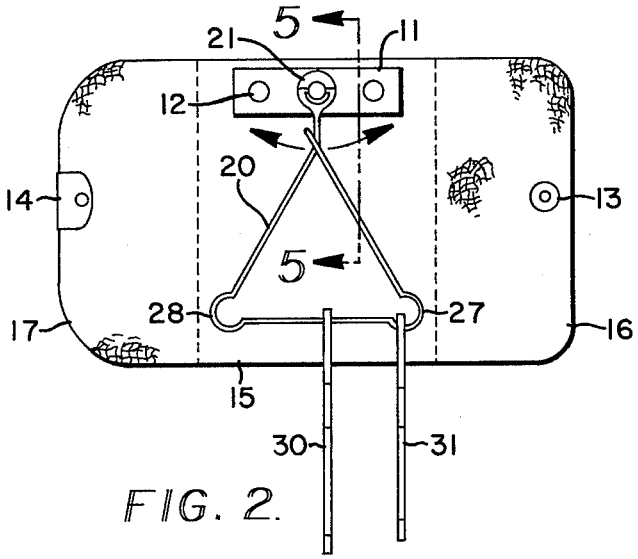
FIG. 2 is a plan view of the embodiment of FIG. 1 with the flaps of the cover completely open showing the first step in repositioning the keys and the triangular keyholder for storage; note that the directional arrows indicate one of the two degrees of freedom allowed by the double hinge attachment mechanism.

The double hinge connection 21 of the key holding loop 20 to the case 10 allows the triangular configured key-holder 20 to swing into the "key-in-use" disposition, FIG. 1, from the "storage" disposition, FIGS. 3 and 4, along any combination of the two directional arrow arcs illustrated in FIGS. 2 and 5. Also see FIG. 1. The metal double hinge or swivel mount mechanism 21 attaches to the back 15 of the case body 10 at a metal base strip 11 by means of rivets 12.

The double hinge or swivel mount 21, as best seen in FIG. 5, comprises a base socket 21 in which a pin 21*a* rotatably rides allowing for complete rotational freedom of movement about an axis of rotation perpendicular to the back side 15 of the case 10 (as indicated by the directional arrows in FIG. 2). Additionally the keyholder loop 20 terminates in two lateral pins 26 which rotatably ride in opposed sockets in the sides of the pin 21*a*, allowing for complete rotational freedom of movement about an axis of rotation perpendicular to the side of the pin 21*a* (as indicated by the directional arrows in FIG. 5). The opposed sockets in the pin 21*a* can be formed merely by putting a lateral hole through and across the pin 21*a* into which the loop pins 26 are inserted.

In order to better understand the interrelationships of the case body 10, the triangular configured loop 20, and the double hinge pivot mechanism 21, the following exemplary method of operation is described.

Method of Operation

The following sequence of operation allow use of the key case 10 beginning in the closed or storage disposition, FIGS. 4 and 5:

1. Snap 13, 14 is unsnapped and the flaps 16 and 17 of the flexible case 10 are opened to expose the keys 30, 31, in their storage disposition, FIG. 3.

2. A key 30 may be selected from the neat, orderly row of keys (two being illustrated for exemplary purposes, but usually many more would be present) retained along the triangle base 23. By grasping only the selected key 30, the case body 10 and the other unselected key(s) 31 will fall down to the attachment corner of the triangular configuration as illustrated in FIG. 1. The key 30 in use is thus fully exposed and separated from the case 10 and the other keys by a significant distance (note dimensional arrows A), allowing for easy handling and manipulation of the key 30 (note directional arrows in FIG. 1) when being inserted into a lock.

In order to store the keys after use of the preselected key 30, the following steps can be used.

1. The case 10 is held in one hand in an upright position as indicated in FIG. 1. With a slight flip of the case body 10 in a circular, upward motion, the triangular key holder 20 will swing down into the position shown in FIG. 2 primarily about the second axis of rotation indicated by the directional arrows of FIG. 5.

2. The keys 30, 31 are then pivoted in an upward direction about the triangle base 23. This may be done by placing the case body 10 in the palm of one hand and placing the thumb on the upper, attachment corner of the loop 20 in order to hold it stationary and flipping the keys in an upward direction about the triangle base 23 with a quick flipping or upward, rotational jerking motion. The keys will thus fall in an orderly manner into the storage disposition shown in FIG. 3. This allows for "one hand" operation, should for example the user's other hand being occupied in carrying something. If necessary or desired, the other hand can be used to move the keys up by direct hand contact into their "upside-down" storage disposition.

3. The flexible case body 10 is then closed and the snap 13, 14 secured.

Exemplary Dimensions

Approximate, exemplary dimensions for the preferred embodiment of the present invention are outlined below:

| | |
|---|---|
| A | 2" |
| B | $2\frac{3}{4}$" |
| C | $\frac{1}{2}$" |
| leg length (22, 23, 24) | $1\frac{3}{4}$" |
| semicircular corners (27, 28) | $\frac{3}{8}$" (diameter) |

Of course such dimensions are subject to substantial variation depending for example on the maximum size and maximum number of keys for which the case is to be used.

This completes the description of the embodiment illustrated herein. However, this invention is not limited to the particular details of construction, components and processes described as many equivalents will suggest themselves to those schooled in the art. It is accordingly desired that the appended claims be given a broad interpretation commensurate with the scope of the invention in the art.

What is claimed is:

1. A key holder for holding a plurality of keys, having holes in them at their bases, comprising:

a backing;

a triangularly shaped, rigid, at least generally flat, loop keyholder means forming a flat, triangular shape having a base and two interconnecting legs for holding the keys when looped through the holes in them; and attachment means connected to the apex corner of said triangularly shaped loop means for attaching said loop means at said legs to said backing, but allowing it to pivot about said backing at said apex corner.

2. A key holder for holding a plurality of keys, having holes in them at their bases, comprising:

a backing;

rigid loop keyholder means forming at least generally a closed shape having a base and at least two interconnecting legs for holding the keys when looped through the holes in them; and attachment means connected to the interconnecting portion of said legs of said loop means for attaching said loop means at said legs to said backing, but allowing it to pivot about said backing; said attachment means comprising a double set of pivots transversely mounted together allowing movement of said loop means about two separate axes of rotation in arcs in two perpendicular planes.

3. The key holder of claim 2 wherein said attachment means further comprises:

a base plate fixedly mounted on said backing; and a rotatable pin mounted perpendicular to said base plate and rotatably mounted on said base plate about an axis of rotation perpendicular to the said base plate, said pin having lateral, opposed sockets defining a second axis of rotation perpendicular to the first axis of rotation, said loop means terminating in opposed pins which are carried by said sockets and allow for rotation of said opposed pins and hence said loop means about said second axis of rotation.

4. A key holder for holding a plurality of keys, having holes in them at their bases, comprising:

a backing;

a rigid, loop keyholder means forming at least generally a closed shape having a base and at least two return legs attached to said base for holding the keys when looped through the holes in them; and attachment means connected to said loop means for attaching said loop means to said backing, but allowing it to pivot about said backing; said loop means having semicircular corners at the intersections of said legs with said base.

5. The key holder of any one of claims 1, 2, or 4, wherein said backing further comprises a case body capable of enclosing said loop means and its keys during storage.

6. A key holder for holding a plurality of keys, having holes in them at their bases, comprising:

a backing;

a rigid, loop keyholder means forming at least generally a closed shape having a base and at least two interconnecting legs for holding the keys when looped through the holes in them; said backing including a case body capable of enclosing said loop means and its keys during storage; and attachment means connected to the interconnecting portion of said legs of said loop means for attaching said loop means at said legs to said backing, but allowing it to pivot about said backing; the keys being stored in an upside-down disposition with their bases lying at said base and their shanks extending upwardly toward said attachment means.

7. The key holder and case of claim 6 wherein the keys lie at an angle to said base in side-by-side, partial face-to-face engagement during storage.

8. A key holder for holding a plurality of keys, having holes in them at their bases, comprising:

a backing;

a rigid, loop keyholder means forming at least generally a closed shape having a base and at least two interconnecting legs for holding the keys when looped through the holes in them; and attachment means connected to the interconnecting portion of said legs of said loop means for attaching said loop means at said legs to said backing, but allowing it to pivot about said backing; said loop means including a spring latching mechanism connecting said two legs together attached to one leg and hooking back over the other leg, allowing keys to be added to and removed from said loop means.

9. A key holder for holding a plurality of keys having holes in them at their bases, comprising:

a backing;

rigid loop key holder means for holding the keys when looped through the holes in them, and attachment means connected to said loop means and said backing for attaching said loop means to said backing but allowing it to pivot about said backing, said attachment means comprising a double set of pivots transversely mounted together allowing movement of said loop means about two separate axes of rotation in arcs in two perpendicular planes.

10. The key holder of claim 9 wherein said attachment means further comprises:

a base plate fixedly mounted on said backing;

a rotatable pin mounted perpendicular to said base plate and rotatably mounted on said base plate about an axis of rotation perpendicular to said base plate, said pin having lateral, opposed sockets defining a second axis of rotation perpendicular to the first axis of rotation, said loop means terminating in opposed pins which are carried by said sockets and allow for rotation of said opposed pins and hence said loop means about said second axis of rotation.

11. The key holder of claim 9 wherein said loop means has at least generally a triangular shape and comprises a base and two interconnecting legs.

12. The key holder of claim 11 wherein said loop means has semicircular corners at the intersections of said legs with said base.

13. The key holder of claim 12 wherein said base further comprises a case body capable of enclosing said loop means and its keys during storage.

14. The key holder of claim 13 wherein the keys are stored in an upside down disposition with their bases lying at said base and their shanks extending upwardly toward said attachment means.

15. The method of holding and storing keys having holes in them at their bases, in a pocket key case, comprising the steps of:

(a) providing a key holder having a backing, a rigid, at least generally flat, loop keyholder having a base leg passing through the holes in the keys, said backing including a case body capable of enclosing said loop means and its keys during storage, and attachment means for pivotally attaching said loop keyholder to said backing at a position substantially removed from said base leg;

(b) in use, grasping the desired key to be used and allowing said base leg to swing up above said attachment means and away from said backing about said attachment means;

(c) after use, moving said base leg down and below said attachment means down against said backing and moving the keys up to an upside down disposition so that their shanks extend up away from said base leg toward said attachment means and along said backing for storage in the pocket key case; and (d) enclosing said case body about said loop means and its keys while the keys are in their upside down disposition for storage in the pocket key case.

16. The method of claim 15, wherein in step "a" there is further included the step of providing said attachment means with a double set of pivots transversely mounted together allowing movement of said loop means about two separate axes of rotation in arcs in two perpendicular planes, and in step "b" there is further included the step of allowing said base leg to swing up and away from said backing in arcs about both of said axes.

17. The method of claim 5, wherein in step "a" there is further included the step of providing said loop means with semicircular corners at the intersections of said legs with said base, and in step "b" there is further included the step of moving the desired key to be used to one of said semicircular corners when grasping the desired key.

18. The key holder of any one of claims 2, 4, 6, or 8, wherein said loop means forms at least generally a flat, triangular shape and said attachment means is connected to the apex corner of said triangular shape.

* * * * *